United States Patent [19]

Abrahamson et al.

[11] Patent Number: 5,045,091

[45] Date of Patent: Sep. 3, 1991

[54] METHOD OF MAKING ROTARY BRUSH WITH REMOVABLE BRUSH ELEMENTS

[75] Inventors: Gerald R. Abrahamson; Ernest J. Duwell, both of St. Paul, Minn.

[73] Assignee: Minnesota Mining and Manufacturing Company, St. Paul, Minn.

[21] Appl. No.: 652,383

[22] Filed: Feb. 5, 1991

Related U.S. Application Data

[63] Continuation of Ser. No. 532,356, May 31, 1990, abandoned, which is a continuation of Ser. No. 307,221, Feb. 6, 1989, abandoned, which is a continuation of Ser. No. 228,859, Aug. 4, 1988, abandoned, which is a continuation of Ser. No. 67,711, Jun. 26, 1987, abandoned.

[51] Int. Cl.[5] ..... B24B 1/00

[52] U.S. Cl. ..... 51/293; 51/334; 51/337; 15/183; 15/195; 15/198

[58] Field of Search ..... 51/334; 15/183

[56] References Cited

U.S. PATENT DOCUMENTS

| | | | |
|---|---|---|---|
| 128,290 | 6/1872 | Dimes | 15/198 |
| 371,745 | 8/1975 | Smith | 15/183 |
| 462,156 | 10/1891 | Penderson | 15/198 |
| 658,416 | 9/1900 | Yale | 15/198 |
| 3,430,281 | 3/1969 | Baumgartner | 15/195 |
| 3,599,264 | 8/1971 | Smith | 15/195 |
| 3,768,214 | 10/1973 | Belanger | 52/332 |
| 4,012,086 | 3/1977 | Kruse | 308/236 |
| 4,055,028 | 10/1977 | Belanger | 51/334 |
| 4,183,183 | 1/1980 | Belanger | 51/334 |
| 4,217,737 | 8/1980 | Hasegawa | 51/334 |
| 4,285,171 | 8/1981 | Block et al. | 51/337 |
| 4,646,479 | 3/1987 | Walker et al. | 51/328 |
| 4,768,923 | 9/1988 | Baker | 415/170 |

FOREIGN PATENT DOCUMENTS

| | | | |
|---|---|---|---|
| 173184 | 3/1915 | Canada | 15/198 |
| 50684 | 1/1910 | Switzerland . | |
| 2106020 | 4/1983 | United Kingdom . | |

*Primary Examiner*—Frederick R. Schmidt
*Assistant Examiner*—Blynn Shideler
*Attorney, Agent, or Firm*—Gary L. Griswold; Walter N. Kirn; Richard Francis

[57] ABSTRACT

A rotary brush with removable brush elements is provided. The brush elements are disposed on a hub in a radial display. The brush elements include a resiliently flexible element which permits the brush to deflect at a greater angle from a rest position than the angle of deflection of the bristles of the brush from a normal position when the hub is rotated with the bristles in contact with the workpiece.

4 Claims, 3 Drawing Sheets

METHOD OF MAKING ROTARY BRUSH WITH REMOVABLE BRUSH ELEMENTS

This is a continuation of application Ser. No. 07/532,356 filed May 31, 1990, (abandoned) which is a continuation of 07/307,221, filed Feb. 6, 1989 (abandoned) which is a continuation of 07/228,859, filed Aug. 4, 1988 (abandoned) which is a continuation of 07/067,711, filed June 26, 1987 (abandoned).

BACKGROUND OF THE INVENTION

1. Field of the Invention

The invention relates to a method of making rotary brushes, and in particular, to rotary brushes with removable brush elements.

Rotary brushes which employ an annular display of bristles have been utilized in a number of applications for the surface finishing of various objects. Such brushes have been used in industrial applications to deburr and/or otherwise provide a surface finish to various manufactured articles.

2. Description of the Prior Art

Rotary brushes are known for surface finishing applications which include a circular hub onto which abrasive loaded filaments are adhered by a layer of cured resin which binds one end of each filament with the opposite end being displayed outward. While such brushes have found great commercial success, the process by which they are made provides certain limitations. First, the brushes are typically made by orienting the individual filaments in a flocking operation to stand erect with one end in a layer of liquid resin which is then cured to provide the brush element. The flocking operation generally limits the trim length of the bristles to less than about 12 cm. Secondly, some of the cured resins used to hold the bristles degrade in the presence of solvents and hot aqueous solutions which may contain acidic or caustic agents, freeing or weakening the bond with the bristles. Finally, the adhered bristles, when deployed on a rotary hub, tend to fail by flexural fatigue at the point where the bristle emerges from the cured resin, caused by repeated deflection and return to normal, as the individual bristles are contacted with the object being finished and such contact is broken as the wheel rotates. This is also a problem with the bristles of brushes that are held on the surface of a hub by mechanical means.

U.S. Pat. No. 4,646,479 and its United Kingdom counterpart U.K. Patent Application GB2 106 020 A, published Apr. 7, 1983, discloses a deburring cylindrical brush which includes a mandrel having attached to it a multiplicity of long abrasive bristles wherein the population density of bristles on the brush is such that the outwardly-extending ends can readily flex both in the plane of rotation and sideways along the lengthwise dimension of the brush. Bristles at their midpoint are wrapped around a rod which is mechanically held in place on the mandrel peripheral surface by spaced flange elements. This results in a brushing surface wherein the bristles attach in fixed position at the face of the mandrel and are subject to flexural fatigue as they deflect in use. After repeated such deflections, the bristles tend to break off at the point of attachment.

While various references disclose finishing wheels comprising a rotary hub having a slotted peripheral surface with abrasive packs inserted into each slot to provide an abrasive flap wheel, none are known to employ bristles in place of abrasive flaps. Each abrasive pack contains like oriented abrasive flaps and the collection of flap packs provides an annulus of abrasive flaps around the hub. Such flap wheels are disclosed, for example, in U.S. Pat. Nos. 3,768,214, 4,217,737 and 4,285,171.

SUMMARY OF THE INVENTION

The present invention provides a method of making a brush element. The method comprises the steps of:

(a) forming a dead soft, cold rolled steel plate to provide a U-shaped metal channel having sidewalls extending in the same direction from a channel bottom;

(b) folding a segment of polymer reinforced fabric having opposite terminal ends its longitudinal center to form a temporary looped end with the folded portions of the fabric touching between the looped end and the terminal ends of the fabric;

(c) fastening together the touching folded portion of the fabric to provide a permanent looped end and unfastened terminal ends;

(d) adhesively bonding one terminal end of the fabric segment over each opposite sidewall of the U-shaped metal channel with the fabric adjacent the exterior of the metal channel so that the permanent loop projects from the channel bottom in an opposite direction as the sidewalls;

(e) inserting into the U-shaped channel a plurality of filaments folded at their midportion;

(f) locking the folded filaments into the channel by placing core rod over the folded midportion of the folded filaments; and, (g) crimping the metal channel locked core rod and filament midportions inside the metal channel to provide the brush element.

The present invention also provides a method of making a rotatable brush. This method comprises the steps of:

(a) preparing a plurality of brush elements as described above;

(b) providing rotatable hub having a peripheral surface and opposite side edges, the hub being slotted to provide a plurality of circumferentially spaced brush fastening slots, each of the slots being open to the peripheral surface and to the side edges and being shaped to have a larger opening at the side edges than at the peripheral surface;

(c) inserting the looped ends of the brush elements into the slots by sliding the looped end from the side edge of the slot into the opening; and (d) inserting an element into each of the loops of the brush elements which is of a size which prevents the withdrawal of the brush element through the peripheral surface while the hub is rotated in use.

The invention provides a rotary finishing wheel which has a hub from which a radial display of bristles emanates. The bristles are attached in a unique manner to greatly reduce flexural fatigue failure, thereby extending the useful life of the brush over brushes of the prior art which have their bristles attached in a conventional manner. It is also possible to obtain brushes with bristles longer than 12 cm since the method of making the brushes of the present invention does not rely on a flocking process.

The rotary brush of the invention includes a hub having spaced brush fastening means. A plurality of removable brush elements are fitted usually with one brush element being attached by one brush fastening means to provide a radial array of brushes. The preferred hub includes generally a cylindrical hub having a peripheral surface and opposite end surfaces. The hub has a plurality of axially extending circumferentially spaced slots opening through the peripheral surface with one brush element in each slot. The brush elements comprise a brush having a plurality of resiliently flexible bristles and a bristle holding means for holding the bristles in a normal generally parallel outwardly projecting orientation relative to the bristle holding means. Each of the brush elements also includes an elongate anchoring means adapted to be engaged in one of the brush fastening means. The brush elements also include a resiliently flexible element having a first end fastened to the anchoring means and an opposite end fastened to the holding means to position the holding means in a radial rest position relative to the hub. The relative flexibility of the bristles and the flexible element permits the flexible element to deflect at a greater angle from the rest position than the angle of deflection of the bristles of the brush from the normal position when the hub is rotated with the bristles in contact with an object being finished.

The preferred bristles are abrasive-loaded polymeric bristles.

DETAILED DESCRIPTION

Figure 1:
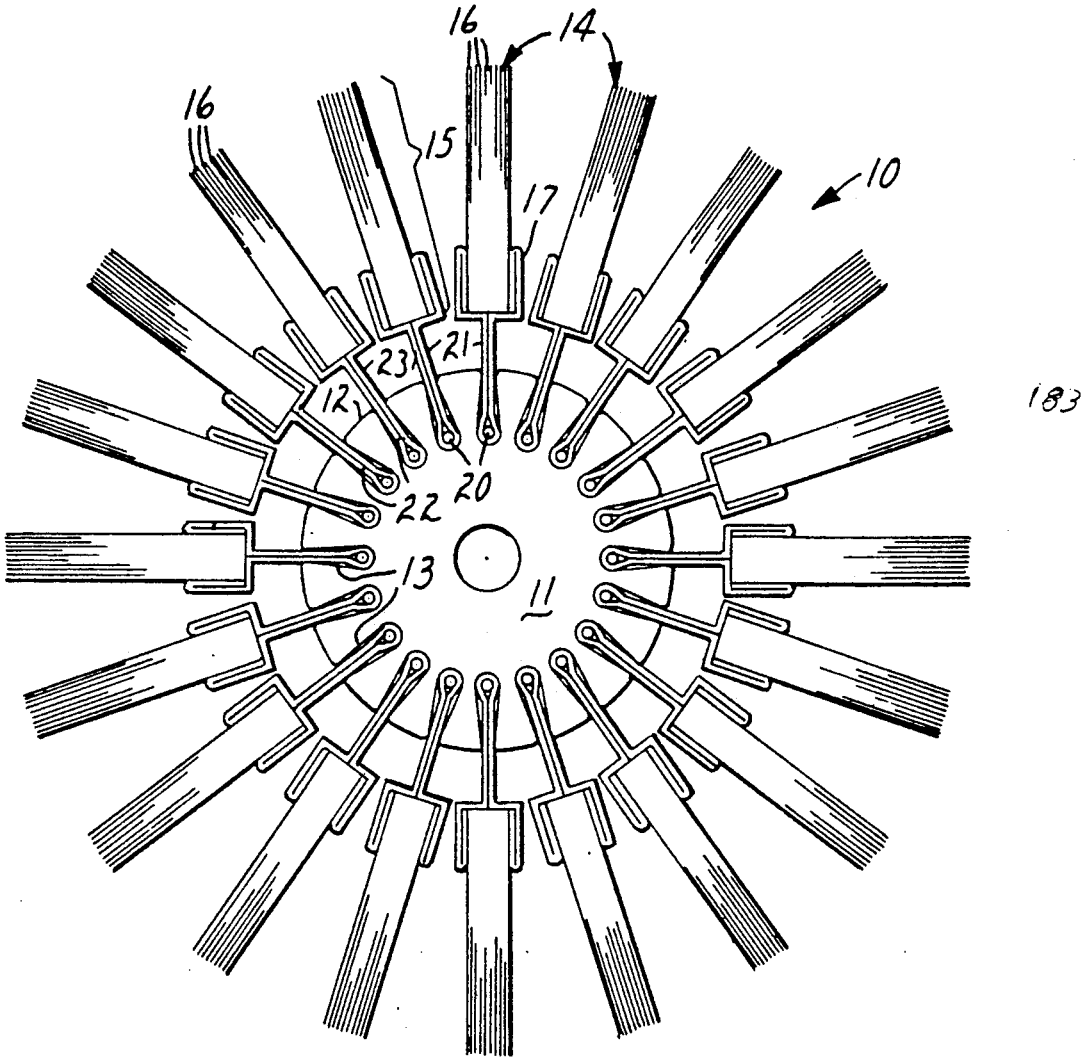
FIG. 1 is an end view of a rotary brush of the present invention.
Figure 2:
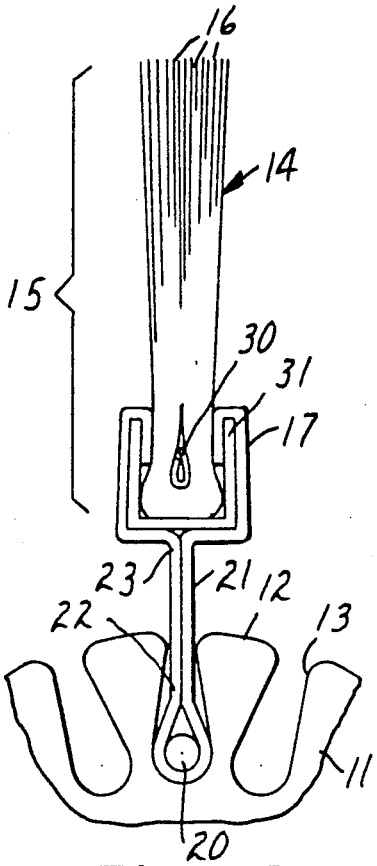
FIG. 2 is a fragmentary end view showing one brush element of the type depicted in FIG. 1 in place on a hub which is partially broken away.

Referring now to FIGS. 1 and 2 of the drawing, rotary brush 10 is shown having a cylindrical hub 11 which has a slotted peripheral surface 12 to provide slots 13 through surface 12 for holding a plurality of brush elements 14 with one brush element 14 in each slot 13. Brush element 14 includes a brush 15 comprised of a plurality of resiliently flexible bristles 16 and a bristle holding means 17 for holding the bristles in a normal generally parallel outwardly projecting orientation relative to bristle holding means 17. Brush element 14 includes at the end opposite brush 15 an elongate anchoring means 20 adapted for engagement in one of slots 13. A resiliently flexible element 21 having a first end 22 fastened to anchoring means 20 and an opposite end 23 fastened to holding means 17 positions which holds holding means 17 in a radial rest position relative to the hub 11.

Figure 5:
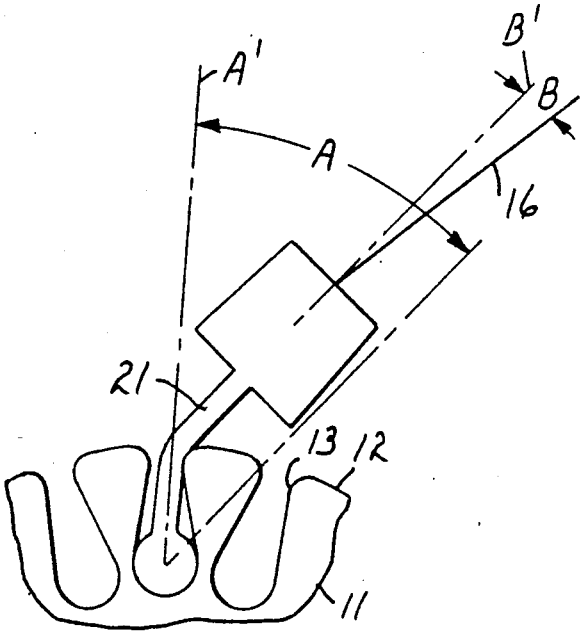
FIG. 5 is a fragmentary end view of the brush element depicted in FIG. 1, except as it would appear in counter-clockwise rotation to show the relative deflection of the brush element and the bristles.
Figure 6:
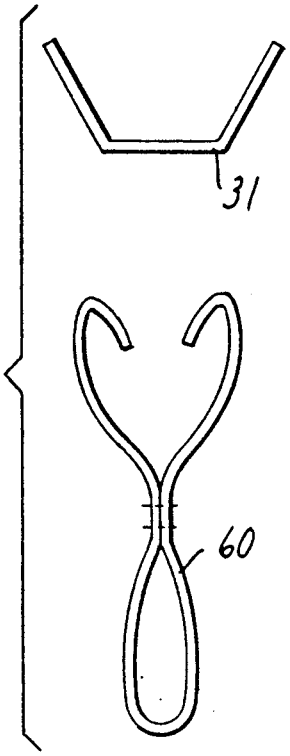
FIG. 6 is an end view of some parts of one embodiment of a bristle holding means.

As shown in FIG. 5, the relative flexibility of bristles 15 and flexible element 21 permits flexible element 21 to deflect at the greater angle (A) from a rest position within A' than the angle (B) of deflection of the bristles 16 of the brush 15 from a normal position B' as the hub 11 is rotated with bristles 16 (shown as a single bristle) in contact with a workpiece (not shown). This relative deflection substantially reduces bristle flexural fatigue.

Hub 11 is generally cylindrically shaped and adapted for rotation on a suitable arbor, not shown, and is made of a suitable material capable of withstanding the rotational forces and mechanical movement of brush elements 14 as rotary brush 10 is rotated under normal working conditions. Suitable materials for forming hub 11 include any of various metals such as aluminum, iron and alloys of iron such as steel, brass, and the like, high modulus plastic materials such as nylon, and the like. The preferred material for making hub 11 is aluminum.

The dimensions of hub 11 will depend upon the particular application and may vary considerably. The diameter of hub 11 typically is on the order of 5 to 30 centimeters. The length of hub 11 typically varies from 3 to 200 centimeters, although shorter and longer lengths are also contemplated.

The number of slots in peripheral surface will also vary, depending upon the diameter of the hub and upon the size of the brush elements. With thicker brush elements and smaller diameter hubs, fewer brush elements are required while larger diameter hubs and thinner brush elements generally require the use of more brush elements. The number of brush elements should be sufficient to provide an adequate radial display of bristles for the particular application. Typically, the number of brush elements will be on the order of 12 for a 5 cm diameter hub to on the order of 60 for a 30 cm diameter hub. It is contemplated that not all of the slots need be fitted with brush elements. For example, alternate slots could be empty or they could contain other types of treating implements such as an element formed of low density abrasive products such as that available under the trade designation "Scotch Brite" or they may be coated abrasive flaps or strips.

Additionally, while the typical deployment of slots is parallel to the axis of rotation, the deployment may be altered to obtain specific results. For example, the slots may be helical in nature as disclosed in aforementioned U.S. Pat. No. 4,285,171 or they may be angled with respect to the axis of rotation.

Slot 13 preferably is enlarged below peripheral surface 12 and open to at least one of the end surfaces of hub 11 so that an appropriately shaped anchoring element 20 (such as a metal rod) may be slipped in from the opening in the end surface to mechanically engage a loop of anchoring element 20 in hub 11 to prevent the loop from being dislodged from hub 11 as the abrasive wheel is rotated. Alternatively, the enlarged portion of anchoring element 20 and resiliently flexible element 21 may be molded as a unitary structure of a moldable material, e.g., nylon, or may be otherwise shaped into a unitary structure, e.g., by machining or by any other suitable means.

Other hub designs may also be useful and they need not have slots for attachment of the brush elements. For example, the hub disclosed in U.S. Pat. No. 3,768,214 may be employed. This patent is incorporated herein by reference for its teaching of the hub construction. It should be noted that, if such a hub is employed, a corresponding brush anchoring element also disclosed should be employed.

Resiliently flexible bristles 16 are preferably formed of polymeric materials such as nylon which is preferably loaded with abrasive particles. Other materials may also be employed to form bristles 16, e.g., non-abrasive polymeric materials, abrasive or non-abrasive wires or the like. The abrasive particles which impregnate bristles 16 are preferably formed of silicon carbide or aluminum oxide although other known abrasive materials are also useful such as ceramic abrasive material (e.g., sold under the trade designation "Cubitron") and fused alumina-zirconia abrasive material such as that sold under the trade designation "NorZon". The fiber length preferably is at least 12 cm, but it may vary from about 2 cm to about 25 cm in length. Longer and shorter fiber lengths are also possible. The fiber diameter may also vary considerably but it typically is within the range of 0.5 to 1.5 mm.

Suitable abrasive fibers are readily commercially available. For example, the E. I. DuPont deNemours Company markets a nylon abrasive filament useful for this purpose under the trade designation "Tynex", such as Tynex A0376, 0378, and 9376, filled with silicon carbide abrasive, and Tynex A9336, filled with aluminum oxide abrasive. These fibers are commercially available in fiber diameters on the order of 18–60 mils (average diameter of about 0.5 to 1.5 mm) containing abrasive particles having a size of about 30 to 600 grade (average particle size of about 20 to 600 micrometers) with a weight percent loading of abrasive on the order of 30–40%. The fibers are available on spools or in hanks in lengths of up to about 100 cm. Similar useful fibers are available from the Allied Fibers Company under the trade designation "Nybrad". Any of these fibers may be crimped.

The abrasive particle size which is loaded into the bristle 16 will vary in size, depending upon the diameter of the bristle 16, with smaller diameter particles being employed in smaller diameter filaments, but generally the abrasive grade size is in the range of about 30 to 600 grade. The loading of abrasive material in the fibers likewise may vary considerably, but it is preferably in the range of 10 to 20% by volume.

The fiber holding means is any convenient way to hold the bristles 16 in place in the proper orientation without undue bristle loss during rotation. Bristle holding means 17 may include a block of cured resin which holds a collection of previously deployed fibers. A preferred bristle holding means is provided as depicted in FIGS. 6–9 by folding a plurality of filaments 32 at their midportion about a suitable element 30 and grasped between the opposed edges of a suitable metal channel 31 which is mechanically engaged over the folded end of the filaments to hold the same in place.

Figure 4:
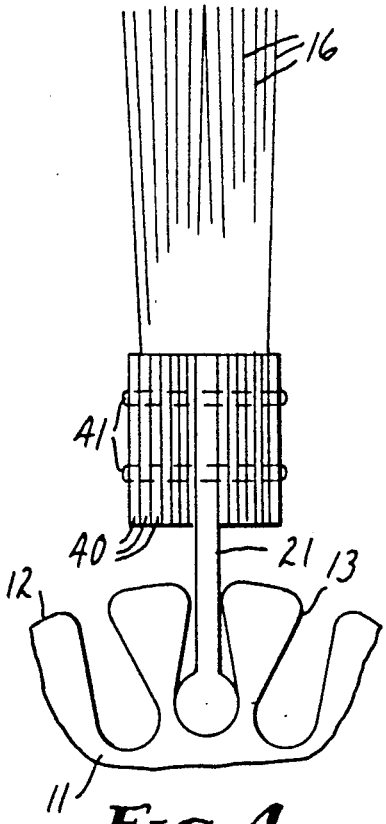
FIG. 4 is a fragmentary end view of another embodiment of the rotary brush of the present invention, again showing a single brush element, with the hub being partially broken away.

FIG. 4 discloses yet another method of holding the bristles 16 in place which employs spaced sheets 40 formed of any suitable material such as paper or cardboard having therebetween a bundle of filaments to provide a stack which is mechanically fastened by suitable means such as staples 41 and may be further reinforced by application of or immersion in a suitable curable resin.

Flexible element 21 can be provided by any of a variety of ways. For example, it may be a thin piece of plastic or metal which is sufficiently flexible yet somewhat rigid or it may be provided by a folded strip of metal or fabric 60 e.g., formed of nylon fibers, as depicted in FIG. 6–9. A particularly useful strip material is a polymer reinforced fabric made with nylon.

The angle (A) of deflection of resiliently flexible element 21 will typically vary from 0°, in a rest position, to about 55°, as the wheel is rotated with the bristles in contact with a workpiece. Similarly, the angle (B) of deflection of the bristles 16 will typically vary from about 0° to about 15°, with the bristles 16 in contact with the workpiece. Deflection will, of course, depend upon the degree of contact and the relative flexibility of each of the materials but the angle (A) of deflection of the flexible element 21 will always exceed the angle (B) of deflection of the bristles 16.

EXAMPLES

The invention is further illustrated by the following examples wherein all parts are by weight, unless otherwise stated.

EXAMPLE 1

Figure 8:
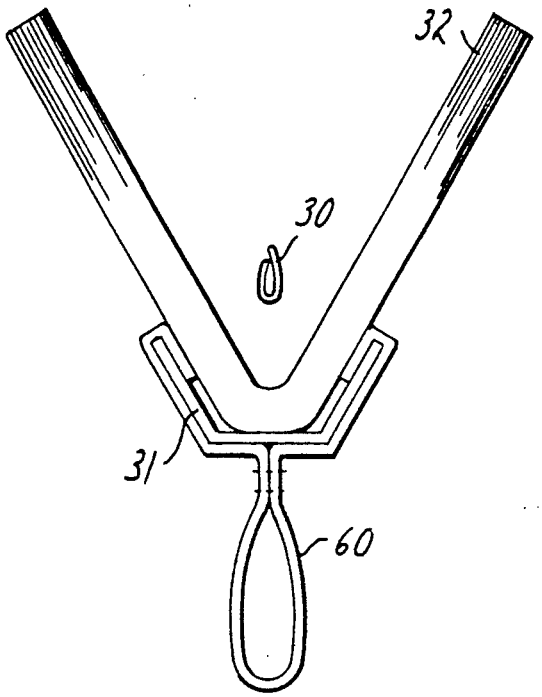
FIG. 8 is an end view of the parts of a brush element in partial assembly.
Figure 7:
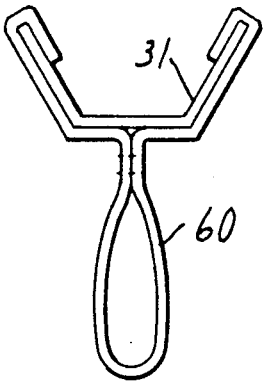
FIG. 7 an end view of the parts of FIG. 6 after assembly.
Figure 9:
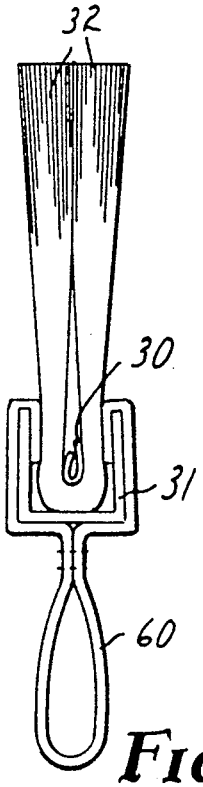
FIG. 9 is an end view of the fully assembled brush element assembled from the parts shown in FIG. 8.

A 20 brush, 20 inch (51 cm) outer diameter, 4 inch (10 cm) wide rotary brush wheel of the type depicted in FIG. 1 was prepared. Although crimping of a folded collection of fibers within a metal channel can be achieved continuously with a series of crimping rolls, crimping of a laid out series of fibers 10–12 fibers deep was achieved in a table vise. The metal channel was formed of ASTM A366 18 gauge (0.046 inch, 1.2 mm) dead soft, cold rolled steel to provide a U-shaped cross section with a ½ inch (13 mm) base and ½ inch (13 mm) legs (approximate dimensions). The fibers were 0.04 inch (1 mm) diameter abrasive-loaded crimped fibers containing 80 grade (average particle size of about 200 micrometers) $Al_2O_3$ abrasive granules, the fibers being commercially available as DuPont "Tynex" fibers. Channel (31) was preformed in a sheet metal brake. A 31×32 basket weave, 7.4 oz./yd$^2$ (251 g/m$^2$), 17 mil (0.43 mm) thick nylon fabric which had been reinforced by saturating with about 21 grains per 4×6 inch area (88 g/m$^2$) and backsizing with about 30 grains per 4×6 inch area (125 g/m$^2$) polyurethane was folded, sewed to form loop (60), and adhesively bonded to the metal channel (as depicted in FIGS. 7–9). The fiber loading was depressed into the metal channel using a core rod (30). Final crimping of the metal channel locked core rod (30) and the fiber mid portions inside the metal channel.

EXAMPLE 2

A 15 brush, 9 inch (23 cm) outer diameter, 2 inch (5 cm) wide, rotary brush wheel having a 3 inch (7.6 cm) diameter hub of the type depicted in FIG. 4 was prepared. A collection of 2-½ inch (6.4 cm), 0.035 inch (0.89 mm) diameter uncrimped DuPont "Tynex" fibers (impregnated with 180 grade, about 80 micrometers in average particle size, SiC abrasive grains) 10 to 12 fiber diameters deep was laid out to the desired length. One inch (2.5 cm) of one end of the fiber collection was immersed in a 2-part curable thermosetting polyurethane resin to bond the fiber collection ends together. A second similarly prepared array of fibers was prepared and the two bundles were placed on either side of a reinforced nylon cloth of the type described in Example 1. Two exterior supportive panels of 20 mil (0.5 mm) thick fiber paper, commercially available as Vulcanized Fibre from NVF Company, surrounded the two bundles and hinge end. The total composite assembly was permanently combined by a series of metal staples. Other means of fastening that could have been employed include stitching, rivets, or similar devices.

CONTROL EXAMPLE

A commercially available Brushlon≐ 9 inch (23 cm) diameter brush band 2 inches (5 cm) wide with a 1½ inch (3.8 cm) fiber trim length of 0.035 inch (0.89 mm) "Tynex" fibers adhered thereon by polyurethane resin was held between flanges to provide a cylinder brush wheel.

EVALUATION

Figure 3:
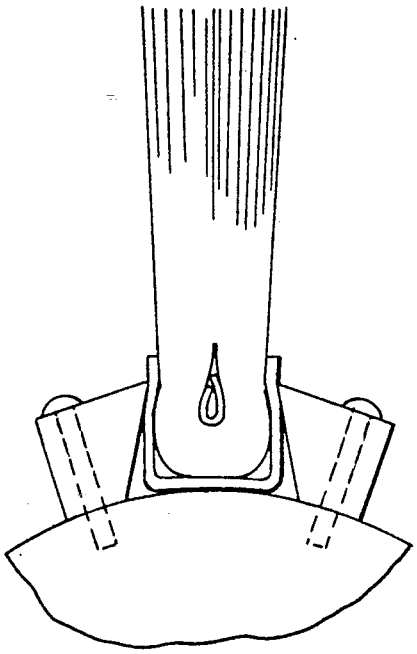
FIG. 3 PRIOR ART
FIG. 3 is a fragmentary end view which shows a conventional way of fastening filaments to a hub illustrative of that known in the prior art.

The brush of Example 1 was run continuously for 300 hours on a laboratory tester at 280 rpm in a ¾ inch (about 19 mm) interference contact with a metal workpiece, with no bristle loss and no evidence of fiber fatigue. A control brush of similar size employing the method of attaching the brush element depicted in FIG. 3 run under the same conditions also had no fiber loss but exhibited fiber movement in use which would result in fiber fatigue and failure if the brush would have been run for a longer period of time.

The brush of Example 2 was run continuously for 12 hours on a laboratory tester at 1,800 rpm in a ¼ inch (about 6 mm) interference contact with a metal workpiece with no bristle loss and no evidence of fiber fatigue. The brush of the Control Example was run on the same equipment under equivalent conditions but before 12 hours usage it had lost all of its bristles with failure by breakage at the fiber base near the point of attachment.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted for specific environments and operative requirements without departing from those principles. The appended claims are intended to cover and embrace any and all such modifications, within the limits only of the true spirit and scope of the invention.

What is claimed is:

1. Method of making a brush element, said method comprising the steps of:

(a) forming a dead soft, cold rolled steel plate to provide a U-shaped metal channel having sidewalls extending in the same direction from a channel bottom;

(b) folding a segment of polymer reinforced fabric having opposite terminal ends at its longitudinal center to form a temporary looped end with the folded portions of the fabric touching between the looped end and the terminal ends of the fabric;

(c) fastening together the touching folded portion of the fabric to provide a permanent looped end and unfastened terminal ends;

(d) adhesively bonding one terminal end of the fabric segment over each opposite sidewall of said U-shaped metal channel with the fabric adjacent the exterior of the metal channel so that the permanent loop projects from said channel bottom in an opposite direction as said sidewalls;

(e) inserting into said U-shaped channel a plurality of filaments folded at their midportion;

(f) locking the folded filaments into the channel by placing a core rod over the folded midportion of said folded filaments; and, (g) crimping the metal channel locked core rod and filament midportions inside the metal channel to provide said brush element.

2. Method of making a rotatable brush, said method comprising:

(a) preparing a plurality of brush elements according to claim 1;

(b) providing rotatable hub having a peripheral surface and opposite side edges, said hub being slotted to provide a plurality of circumferentially spaced brush fastening slots, each of said slots being open to said peripheral surface and to said side edges and being shaped to have a larger opening at said side edges than at said peripheral surface;

(c) inserting the looped ends of said brush elements into said slots by sliding said looped end from the side edge of said slot into said opening; and (d) inserting an element into each of said loops of said brush elements which is of a size which prevents the withdrawal of said brush element through said peripheral surface while said hub is rotated in use.

3. Method of making a brush element, said method comprising the steps of:

(a) folding a segment of polymer reinforced fabric having opposite terminal ends at its longitudinal center to form a temporary looped end with the folded portions of the fabric touching between the looped end and the terminal ends of the fabric;

(b) fastening together the touching folded portions of the fabric to provide a permanent looped end and touching terminal ends;

(c) assembling a stack comprised of sheets having a bundle of filaments between each of said sheets with the touching terminal ends of said fabric segment within the stack; and (d) mechanically fastening together the sheets, filaments and fabric ends in said stack to provide said brush element.

4. Method of making a rotatable brush, said method comprising:

(a) preparing a plurality of brush elements according to claim 3;

(b) providing rotatable hub having a peripheral surface and opposite side edges, said hub being slotted to provide a plurality of circumferentially spaced brush fastening slots, each of said slots being open to said peripheral surface and to said side edges and being shaped to have a larger opening at said side edges than at said peripheral surface;

(c) inserting the looped ends of said brush elements into said slots by sliding said looped end from the side edge of said slot into said opening; and (d) inserting an element into each of said loops of said brush elements which is of a size which prevents the withdrawal of said brush element through said peripheral surface while said hub is rotated in use.

* * * * *

UNITED STATES PATENT AND TRADEMARK OFFICE

CERTIFICATE OF CORRECTION

PATENT NO. : 5,045,091

DATED : September 3, 1991

INVENTOR(S) : ABRAHAMSON, ET AL.

It is certified that error appears in the above-identified patent and that said Letters Patent is hereby corrected as shown below:

On the title page, under references cited, "371,745" should read --3,751,745--.

Col. 7, line 6, "Brushlon≐" should read --Brushlon™--.

Signed and Sealed this

Thirtieth Day of March, 1993

*Attest:*

STEPHEN G. KUNIN

*Attesting Officer*

*Acting Commissioner of Patents and Trademarks*